US008033645B2

(12) United States Patent
Van Den Berg et al.

(10) Patent No.: US 8,033,645 B2
(45) Date of Patent: Oct. 11, 2011

(54) ORIFICE PLATE FOR AN INK-JET PRINT-HEAD AND A METHOD FOR MANUFACTURING THE ORIFICE PLATE

(75) Inventors: Marcus J Van Den Berg, Venlo (NL); Evgenij V. Kuznetsov, Venlo (NL); Bene Poelsema, Enschede (NL); Ernst S. Kooij, Hengelo (NL)

(73) Assignee: OCE-Technologies B.V., Venlo (NL)

( * ) Notice: Subject to any disclaimer, the term of this patent is extended or adjusted under 35 U.S.C. 154(b) by 263 days.

(21) Appl. No.: 12/341,260

(22) Filed: Dec. 22, 2008

(65) Prior Publication Data

US 2009/0237453 A1 Sep. 24, 2009

(30) Foreign Application Priority Data

Dec. 21, 2007 (EP) ..... 07123927

(51) Int. Cl.
*B41J 2/14* (2006.01)

(52) U.S. Cl. ..... 347/47; 427/466

(58) Field of Classification Search ..... 347/40, 347/43, 71, 19, 47; 427/466
See application file for complete search history.

(56) References Cited

U.S. PATENT DOCUMENTS

| | | | |
|---|---|---|---|
| 5,434,606 | A | 7/1995 | Hindagolla et al. |
| 6,312,103 | B1 | 11/2001 | Haluzak |
| 2002/0001016 | A1 | 1/2002 | Aono et al. |
| 2006/0033783 | A1 | 2/2006 | Bruinsma et al. |

FOREIGN PATENT DOCUMENTS

| | | | |
|---|---|---|---|
| EP | 0694400 | A2 | 1/1996 |
| JP | 2002-355957 | A | 12/2002 |
| JP | 2007-245549 | A | 9/2007 |

*Primary Examiner* — Lamson Nguyen
(74) *Attorney, Agent, or Firm* — Birch, Stewart, Kolasch and Birch, LLP

(57) ABSTRACT

An orifice plate for an ink jet print-head for ejecting drops of an ink, wherein the orifice plate includes an outer surface, which has a wettability with the ink, and at least one orifice arranged in the outer surface, said orifice being configured for ejecting ink drops, each orifice having an edge, the edge defining a transition boundary between the orifice and the outer surface, wherein the wettability of the outer surface is poor near the edge of the at least one orifice and the wettability increases with increasing distance from the edge of the orifice, the increasing wettability with the increasing distance from the edge of the orifice providing a driving force for moving residual ink drops away from the edge towards a wettable region, thereby reducing the risk of disturbing the trajectories of subsequent ejected ink drops.

25 Claims, 2 Drawing Sheets

ORIFICE PLATE FOR AN INK-JET PRINT-HEAD AND A METHOD FOR MANUFACTURING THE ORIFICE PLATE

This non-provisional application claims priority under 35 U.S.C. §119(a) on European Patent Application No. 07123927.1 filed in the European Patent Office on Dec. 21, 2007, which is herein incorporated by reference

BACKGROUND OF THE INVENTION

The present invention relates to an orifice plate for an ink jet print-head for ejecting drops of an ink, the orifice plate comprising an outer surface which has a wettability with the ink, and at least one orifice arranged in the outer surface, the orifice being configured for ejecting ink drops, each orifice having an edge, the edge defining a transition boundary between the orifice and the outer surface, the wettability of the outer surface being poor near the edge of the at least one orifice. The present invention also relates to a method for manufacturing such an orifice plate.

An orifice plate of this kind is known from U.S. Pat. No. 5,434,606. According to U.S. Pat. No. 5,434,606 an orifice plate comprises an outer surface and at least one orifice comprising an edge, wherein a portion of the outer surface near the edge is non-wetting. Thus accumulation of residual ink drops near the edge of the at least one orifice is prevented, which residual ink drops may otherwise disturb the trajectories of subsequent ink droplets, leading to a deterioration in the print quality. Residual ink drops which are larger than the width of the non-wetting region may experience a driving force to move towards regions of the outer surface that are wettable with the ink and will automatically flow away from the edges of the orifices towards those regions. However, residual ink drops which are smaller than the width of the non-wetting region will bead on the non-wetting portion of the outer surface and stay there.

The orifice plate disclosed in the cited reference has the disadvantage that a small residual drop (smaller than the width of the non-wetting region) that has landed near an edge of an orifice, may disturb the trajectories of multiple subsequent ejected ink drops.

SUMMARY OF THE INVENTION

It is an object of the present invention to provide an orifice plate with an outer surface that eliminates residual ink drops in the vicinity of the edge of the at least one orifice and collects the residual ink drops on the outer surface at a sufficiently large distance from the edges of the orifices.

This object is achieved by providing an orifice plate wherein the wettability increases gradually with increasing distance from the edge of the at least one orifice. If, during printing, a residual ink drop lands on the non-wetting region near the edge of the orifice, the front end (i.e., farthest from the edge of the orifice) of a residual ink drop experiences a higher wettability than the tail end (i.e., nearest to the edge of the orifice), which causes the residual drop to move away from the edge of the orifice. This effect originates in the fact that the ink has a larger affinity with wettable regions of the outer surface of the orifice plate than with non-wettable regions. Therefore, the residual ink drops accumulate on those portions of the outer surface of the orifice plate that are wettable with the ink, hence the residual ink drops will no longer disturb the trajectories of the subsequent ejected ink drops.

In one embodiment the wettability with the ink increases gradually with increasing distance from the edge of the at least one orifice. In such a configuration, a residual ink drop on the outer surface of the orifice plate near the edges of the orifices continuously experiences a driving force for movement away from the edges of the orifices, regardless of the size of the said residual ink drops.

Thus, the outer surface of the orifice plate near the edge of the at least one orifice comprises a low surface tension, the surface tension increasing with increasing distance from the edge of the at least one orifice.

The wettability can be determined by an anti-wetting agent provided on the outer surface of the orifice plate. For example, the anti-wetting agent may be present as a self assembled monolayer. In this embodiment, the outer surface of the orifice plate is substantially wetting, while the anti-wetting agent is provided on the outer surface of the orifice plate near the edges of the orifices.

In another embodiment the anti-wetting agent is provided such that a gradient in surface coverage of the outer surface of the orifice plate with the anti-wetting agent is present, the surface coverage being high near the edge of the at least one orifice and decreasing with increasing distance from the edge of the at least one orifice.

In a further embodiment the anti-wetting agent is provided in a pattern, preferably the pattern comprising a gradually decreasing surface coverage with the anti-wetting agent with increasing distance from the edge of the at least one orifice.

Advantageously the anti-wetting agent comprises a thiol compound, for example a perfluoro-thiol compound.

In a further embodiment the outer surface of the orifice plate can be provided with a transition layer, the transition layer being configured to accommodate the anti-wetting agent. The transition layer can comprise a metal layer, for example a gold layer.

An ink jet print-head can be provided with an orifice plate according to the present invention. Also, a printer can be provided with an ink jet print-head comprising the orifice plate according to the present invention.

In another aspect of the present invention a method for manufacturing an orifice plate is provided, the method comprising the steps of:

- providing an orifice plate having an outer surface, at least one orifice arranged in the outer surface, the orifice having an edge, the edge defining a transition boundary between the orifice and the outer surface;
- providing the outer surface of the orifice plate with a transition layer in a gradual pattern around the orifices; and
- providing an anti-wetting agent on the transition layer.

In an embodiment the orifice plate is chemically coated.

BRIEF DESCRIPTION OF THE DRAWINGS

The present invention will now be explained in more detail with reference to the appended drawings showing non-limiting embodiments and wherein.

DETAILED DESCRIPTION OF THE INVENTION

Figure 1:
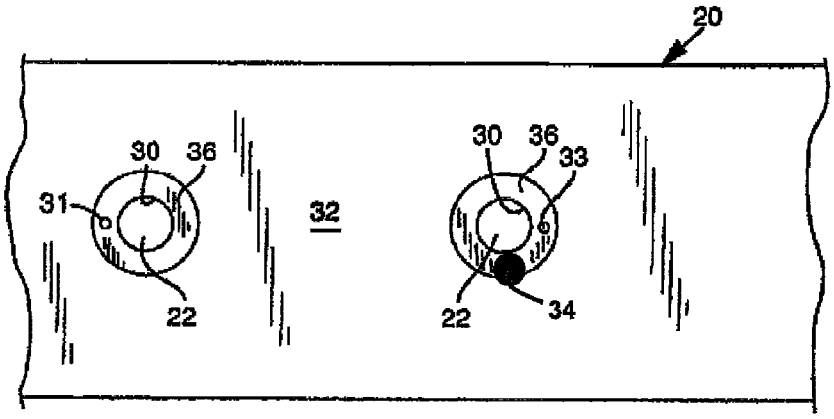
FIG. 1 shows a schematic graphical representation of an orifice plate with wetting and non-wetting regions as known from the prior art.

FIG. 1 shows a graphical representation of an orifice plate with a non-wetting region near the edge of the orifice, as known from the prior art.

Orifices (22), also referred to as a nozzle having edges (30) arranged in the outer surface (20) of the orifice plate. An edge of an orifice defines a transition boundary between an orifice and the outer surface. In an annular region around each nozzle the outer surface of the orifice plate is substantially non-wetting with the ink that is ejected through the orifices; these regions are referred to as the non-wetting regions (36'). Outside the non-wetting regions, the outer surface (32) of the orifice plate is substantially wettable with the ink.

During printing, ink drops may be ejected through the nozzles. The ejected ink drops follow a trajectory in a direction substantially perpendicular to the outer surface of the orifice plate. Due to break-tip of a drop, before or after detaching from a nozzle, residual ink drops may—unintentionally—land on the outer surface of the orifice plate (31, 33, 34).

If a residual ink drop ends up on a non-wetting region near an edge of a nozzle, the contact angle between an ink drop and a non-wetting region of outer surface may be relatively high due to the low surface tension of the non-wetting region. In case a residual ink drop ends up on the wetting region (32) it tends to spread more (i.e., the contact angle will be lower), because the surface tension of the outer surface is higher than that of the non-wetting region.

The non-wetting regions prevent residual ink drops from flowing towards an edge of a nozzle and ultimately back into the nozzle. A residual ink drop that has landed on a non-wetting region, and which drop is larger than the widths of the non-wetting region (34), is partly situated on a wettable portion of the outer surface (32). A difference in surface energy between a first portion of an edge of an ink drop and a second portion of the edge of the same ink drop may result in contact angle difference across the ink drop. This in turn may provide a driving force for movement of the ink drop from surface regions having a lower surface energy to regions having a higher surface energy. In other words: a larger affinity of a residual ink drop with a wettable portion of the outer surface, induces the residual ink drop to move or flow away from the non-wetting regions, away from the nozzle. The difference in wettability is a driving force for movement of such an ink drop. Thus, the risk of disturbing the trajectories of subsequent ejected drops is reduced. However, a residual ink drop that has landed on a non-wetting region and which ink drop is smaller than the width of the non-wetting region (e.g., the ink drops indicated by 31 and 33) does not move, because the previously described driving force for causing the movement is lacking. Small ink drops (31 and 33) stay in the vicinity of the edges of the nozzles, until otherwise removed, for example by gravity, a wiping procedure or the like.

A residual ink drop caused by the ejection of a subsequent ink drop may also land on the same non-wetting region near the edge of the nozzle, possibly causing accumulation of multiple residual ink drops near the edge of the nozzle. In the event that small drops coagulate to form a larger drop like 34, the large drop tends to move or flow away from the edge of the nozzle. During coagulation of multiple small drops to form a larger drop, the trajectories of subsequent ejected ink drops may be influenced by the growing drop and hence may lead to an inferior print quality.

Figure 2A:
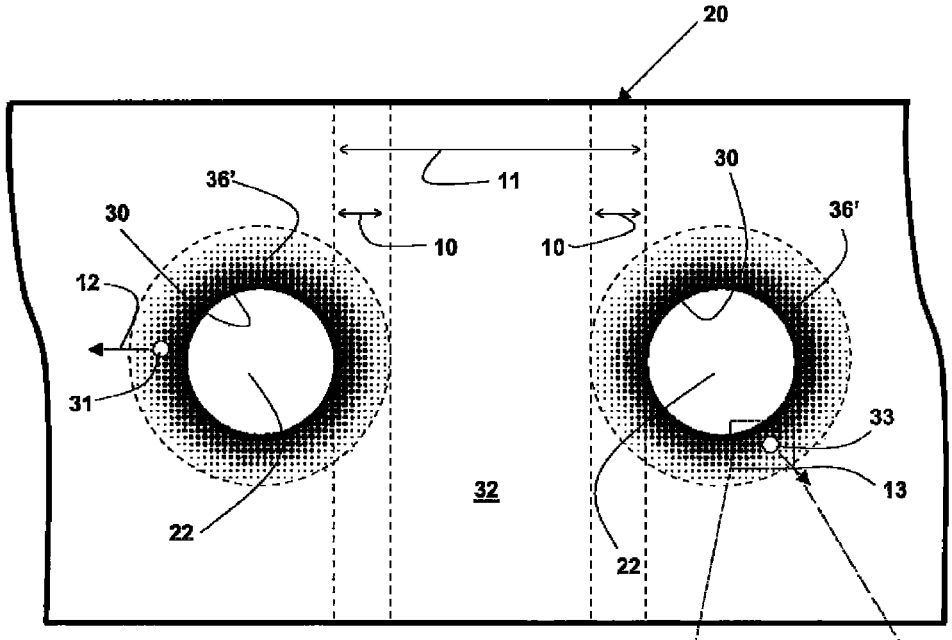
FIG. 2*a* shows a schematic graphical representation of an embodiment of the orifice plate with wetting and non-wetting regions according to the present invention.

FIG. 2*a* shows an outer surface (20) of an orifice plate comprising at least one orifice (22) with an edge (30). Near the edges of the orifices, regions (36') with a gradually increasing wettability are provided. The gradient starts with a substantially non-wetting behaviour near the edges (30) of the nozzles (22) which gradually changes into a substantially wetting behavior with increasing distance from the edges of the nozzles, with such a gradient that the widths (10) of the gradient regions (36') are smaller than half the distance (11) between the closest edges of two adjacent nozzles (i.e., there is no overlap of gradient regions of adjacent nozzles).

In this example, the wettability gradient is applied in a dot-pattern, the dots being zones that are provided with a gold layer. On top of the gold layer an anti-wetting agent is provided, the anti-wetting agent being a thiol compound, for example a perfluoro-thiol compound. The thiol compound may for example be provided as a self-assembled monolayer.

Figure 2B:
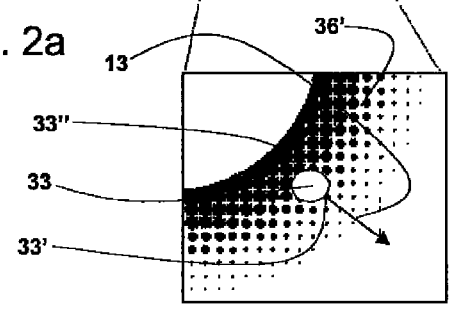
FIG. 2*b* shows a schematic graphical representation of an enlarged part of the orifice plate that is shown in FIG. 2*a;*

In the embodiment shown in FIG. 2*a* and FIG. 2*b*, a size of each dot in the pattern is selected such that each dot is smaller than a smallest expected residual ink drop, for reasons explained below.

On a microscopic scale only two types of regions are present: wettable (i.e., regions without anti-wetting agent) and non-wettable regions (i.e., dots provided with anti-wetting agent). On a macroscopic scale (i.e., as experienced by a residual ink drop) the dotted pattern results in a wettability gradient.

During printing, residual ink drops may land on the outer surface of the orifice plate. FIG. 2*b* shows that if a residual ink drop ends up in the region (36') provided with a wettability gradient (e.g., ink drop 33), the front end (33') of a residual ink drop experiences a higher wettability of the outer surface than the tail end (33"), regardless of the position of the residual ink drop within the gradient region (36'). The difference in wettability of the outer surface underneath the residual ink drop is a driving force for movement of the residual drop towards a region with a higher wettability, which is towards the front end of the residual ink drop. The residual ink drop therefore moves away from the edge of the orifice towards region 32 (see FIG. 2*a*), as indicated by arrows 12 and 13. An essential feature for the above described mechanism to work, is the presence of a macroscopic (i.e., at the scale corresponding to the size of the residual ink drops) wettability gradient.

Figure 3:
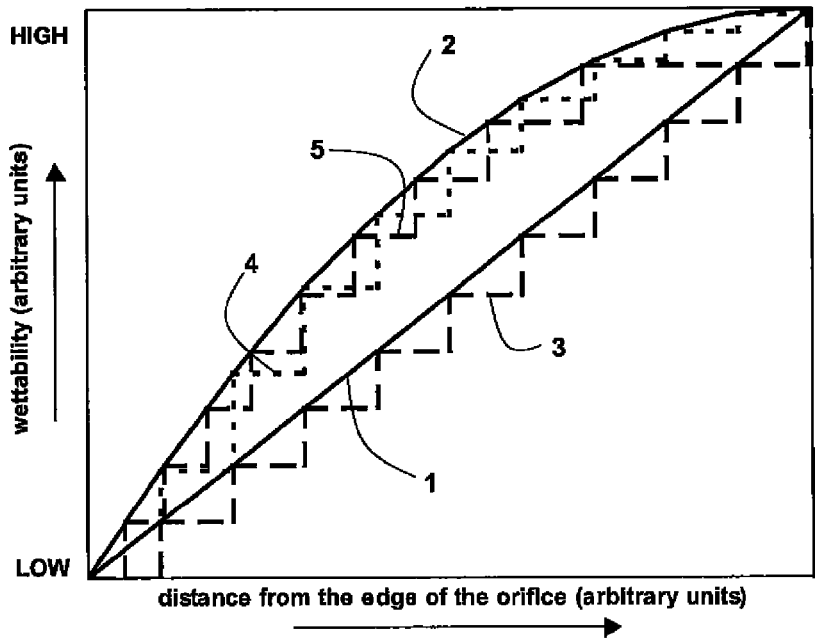
FIG. 3 shows schematic graphical representations of a number of embodiments of increasing wettability with increasing distance from the edge of at least one orifice, in accordance with the present invention.

FIG. 3 shows a graph. The horizontal axis of the graph represents the distance from an edge of a nozzle. The vertical axis of the graph represents the wettability of the outer surface of an orifice plate. The units of both distance and wettability are arbitrary units.

A first solid line (1) represents a first embodiment in which a linear wettability gradient is present around an orifice on the outer surface of an orifice plate; a second solid line 2 represents a second embodiment in which a non-linear wettability gradient is present; the wettability gradient has the same magnitude as the wettability gradient represented by solid line 1 (i.e., the same total wettability increase over the same total distance); and the wettability has a higher initial slope, which slope decreases towards the end of the gradient.

The wettability gradient represented by solid line (2) offers a larger driving force for movement of a residual ink drop away from the edge of an orifice, in a region near the edge. A residual ink drop that lands near an edge of an orifice tends to move more quickly away from the edge of an orifice, than a residual ink drop that lands at a larger distance from the edge of an orifice. In other words: a residual ink drop that lands on a more critical region of the outer surface of an orifice plate (i.e., near an edge of an orifice where the risk of disturbing a subsequent ejected ink drop is largest) is quickly removed from that area.

The third, fourth and fifth dotted lines (3, 4 and 5, respectively) each represent a discrete step-wise increasing wettability with increasing distance from the edge of an orifice. In practice these schemes may be applied on the outer surface as annular regions (i.e., rings) around the orifices with increasing wettability with increasing distance from the edges of the orifices.

The third line (3) shows a third embodiment, in which the linear wettability gradient (1) is represented by a discrete step-wise variation. The fourth line (4) shows a fourth embodiment in which the non-linear wettability gradient (2) is represented by a first discrete step-wise variation, wherein the width of the annular regions is constant and the step-size in wettability decreases with increasing distance from the edge of an orifice. The fifth line (5) shows a fifth embodiment in which the non-linear wettability gradient (2) is represented by a second discrete step-wise variation, wherein the step-size in wettability is constant and the width of the annular regions increases with increasing distance from the edge of the orifice.

The discrete step-wise variations of the gradients represented by the third, fourth and fifth line (3, 4 and 5, respectively) may be applied on a microscopic or a macroscopic scale. In the first case, the spatial step-size (i.e., step-size in distance from the edge of an orifice) is small compared to the expected size of residual ink drops. In the latter case, the spatial step-size may be relatively large compared to the expected size of a residual ink drop.

Considering the embodiments shown in FIG. 2, it is clear to the skilled person that many variations of a wettability are possible and fall within the scope of the present invention.

Figure 4:
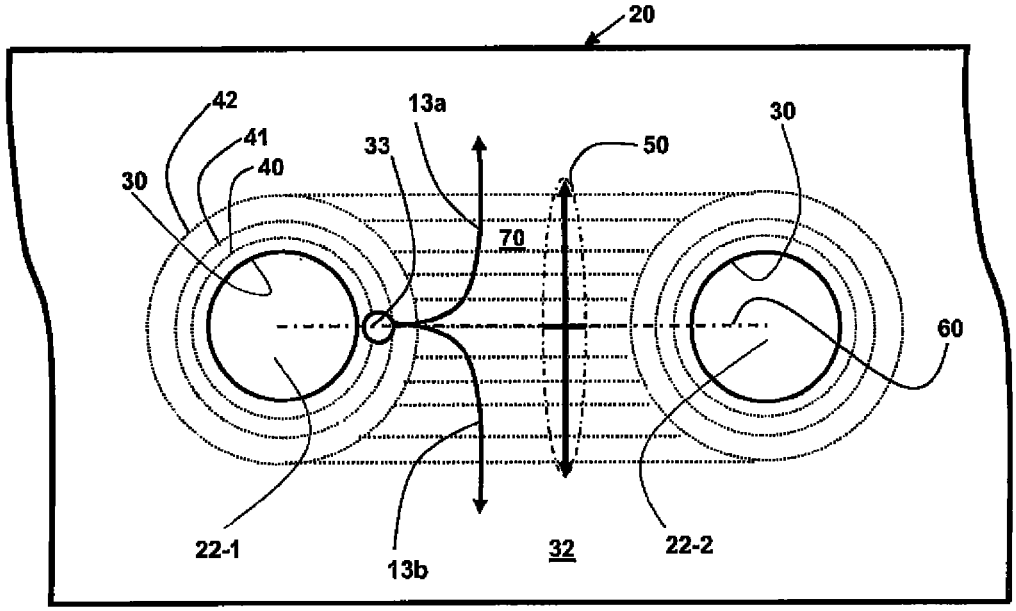
FIG. 4 shows a schematic graphical representation of an embodiment of the orifice plate with wetting and non-wetting regions according to the present invention.

FIG. 4 shows yet another embodiment of the orifice plate according to the present invention. For clarity reasons, the wettability gradient is represented by a limited number of iso-wettability lines (i.e., lines with constant average wettability). The pattern required to obtain such a wettability gradient may be based on the profiles shown in FIG. 2 and/or any variation falling within the scope of the present invention.

In this embodiment there is provided a first wettability gradient around and near the nozzle edges (30), defined by iso-wettability lines 40, 41 and 42, and a second wettability gradient in an area (70) between two adjacent nozzles (22-1 and 22-2), represented by the horizontal iso-wettability lines on either side of a diametric line (60) between two adjacent nozzles. The wettability with an ink in the second wettability gradient area (70) decreases with increasing distance from the diametric line (60), as indicated by double arrow (50). The wettability at the location of the diametric line (60) is preferably substantially equal or substantially lower than the wettability of a region between the iso-wettability lines 41 and 42.

This combination of the first and the second wettability gradient provides an overall wettability gradient that prevents accumulation of ink drops in the area between two adjacent nozzles. If for example an ink drop (33) lands on the nozzle plate near the edge of a nozzle (30) on or near the diametric line (60), the ink drop will experience a driving force to move away from the nozzle edge, towards the second wettability gradient. The second wettability gradient will direct the ink drop away from the diametric line (60). An exemplary overall ink drop trajectory is indicated by the arrows 13*a* or 13*b*, dependent on the exact starting location of the ink drop. In any case, an ink drop will move away from a nozzle edge, without ending up in the area (70) between two adjacent nozzles.

It is noted that the iso-wettability lines may have a different shape, for example elliptical, parabolic or curved. Other shapes may be of use when specific ink drop trajectories of ink drops that have landed on the outer surface of the orifice plate are desired.

Hereinafter, an embodiment of a method for applying a wettability gradient on the outer surface of an orifice plate is demonstrated.

An orifice plate may be produced by electro-formation, which is a technique well known in the industry. After the orifice plate has been produced, the outer surface (32 in FIG. 1, FIG. 2*a* and FIG. 2*b*) is generally non-wetting (e.g., it possesses a nickel or gold-plated nickel outer surface). To achieve the desired wetting and anti-wetting properties according to the present invention, the orifice plate is first coated with a photoresist material, the photoresist material covering the entire outer surface of the orifice plate. The second step is providing and positioning a mask with a pattern according to the desired pattern of wettable and non-wettable regions on the outer surface of the orifice plate (e.g., the dot-pattern shown in FIG. 2*a* and FIG. 2*b*), on top of the outer surface of the orifice plate. The assembly is then exposed to radiation, which causes the photoresist to react. Two types of reaction are possible: 1) degradation of the photoresist, and 2) curing of the photoresist. Photoresists that react according to the first reaction require a negative mask (i.e., radiation transparent where wetting regions are required and the non-wetting surface has to be removed). Photoresists which react according to the second reaction require a positive mask (i.e., radiation transparent where non-wetting regions are required and the non-wetting surface should be maintained). The next step is removing the photoresist with a solvent from those parts of the outer surface that are intended to become wetting. The underlying non-wetting surface is subsequently removed by e.g., wet etching or reactive plasma etching. Finally the remaining photoresist is removed with the aid of a solvent. The outer surface of the orifice plate then comprises a pattern e.g., as shown in FIG. 2*a* and FIG. 2*b*. Various patterns are possible and relatively easy to create by selecting different masks.

The above-described method for producing a pattern on the outer surface of the orifice plate is similar to photolithographic techniques known in the semi-conductor industry.

The final step is providing an anti-wetting agent on the outer surface of the orifice plate, which can be done in various ways: e.g., dipping the orifice plate in a liquid anti-wetting agent or applying the anti-wetting agent by one of the numerous coating techniques known in the art.

The anti-wetting compound preferably adheres to those portions of the outer surface that are not removed by etching and preferably forms a self-assembled monolayer on those portions of the outer surface.

Optionally the ink may comprise the anti-wetting compound to be able to restore the self-assembled monolayer if the layer is disturbed or destroyed due to events like a paper crash, a wiping procedure or other incidents that may cause mechanical damage to the orifice plate.

The following are some examples of anti-wetting coatings known in the art.

- Perfluoroalkanethiol may be applied on gold. For example, a nickel (Ni) or silicon (Si) orifice plate may be provided with a gold layer as a transition layer;
- Perfluoroalkanetrichlorosilane may be applied on an orifice plate provided with a transition layer comprising a first layer consisting of approximately 50 nm of chrome (Cr) and a second layer consisting of approximately 300 nm of $SiO_x$ in which x is about 1.5; and Perfluoroalkanetrichlorosiliane may be applied on an orifice plate provided with a transition layer comprising a natural or artificial $SiO_2$ layer.

Other known anti-wetting agents may be: teflon-like compounds, for example applied by chemical vapour deposition (CVD) techniques, alkanes and silicones.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An orifice plate for an ink jet print-head for ejecting drops of an ink, the orifice plate comprising:

an outer surface, which has a wettability with the ink; and at least one orifice arranged in the outer surface, the orifice being configured for ejecting ink drops, each orifice having an edge, the edge defining a transition boundary between the orifice and the outer surface;

the wettability of the outer surface being poor near the edge of the at least one orifice, wherein the wettability increases gradually with increasing distance from the edge of the at least one orifice wherein the outer surface near the edge of the at least one orifice contains low surface tension, the surface tension increasing with an increasing distance from the edge of the at least one orifice.

2. The orifice plate according to claim 1, wherein the wettability is determined by an anti-wetting agent provided on the outer surface thereof.

3. The orifice plate according to claim 2, the anti-wetting agent is present as a self assembled monolayer.

4. The orifice plate according to claim 2, wherein the anti-wetting agent is provided such that a gradient in the anti-wetting agent is present in surface coverage of the outer surface thereof, the surface coverage being high near the edge of the at least one orifice and decreasing with increasing distance from the edge of the at least one orifice.

5. The orifice plate according to claim 4, wherein the anti-wetting agent is provided in a pattern.

6. The orifice plate according to claim 5, wherein the pattern has a dot configuration.

7. The orifice plate according to claim 5, wherein the pattern comprises a gradually decreasing surface coverage with the anti-wetting agent with increasing distance from the edge of the at least one orifice.

8. The orifice plate according to claim 2, wherein the anti-wetting agent comprises a thiol compound.

9. The orifice plate of claim 8, wherein the thiol compound is a perfluoro thiol compound.

10. The orifice plate according to claim 2, wherein the outer surface of the orifice plate is provided with a transition layer, the transition layer being configured to accommodate the anti-wetting agent.

11. The orifice plate according to claim 10, wherein the transition layer comprises a metal layer.

12. The orifice plate of claim 11, wherein the metal layer is a gold layer.

13. The orifice plate according to claim 1, wherein the orifice plate comprises an area between two adjacent nozzles containing a wettability gradient such that the wettability with ink in the area between the two adjacent nozzles decreases with increasing distance from a diametric line between the two adjacent nozzles.

14. An ink jet print-head comprising the orifice plate of claim 1.

15. A printer comprising the ink jet print-head according to claim 14.

16. A method of manufacturing an orifice plate comprising the steps of:

providing an orifice plate having an outer surface having a wettability with the ink, at least one orifice arranged in the outer surface for ejecting ink drops, the orifice having an edge, said edge defining a transition boundary between the orifice and the outer surface;

providing the outer surface of the orifice plate with a transition layer in a gradual pattern around the at least one orifice; and providing an anti-wetting agent on the transition layer, wherein the wettability of the outer surface is poor near the edge of the at least one orifice, and the wettability increases gradually with increasing distance from the edge of the at least one orifice, and wherein the outer surface near the edge of the at least one orifice contains low surface tension, the surface tension increasing with an increasing distance from the edge of the at least one orifice.

17. The method according to claim 16, wherein the orifice plate is chemically coated.

18. An orifice plate for an ink jet print-head for ejecting drops of an ink, the orifice plate comprising:

an outer surface, which has a wettability with the ink; and at least one orifice arranged in the outer surface, the orifice being configured for ejecting ink drops, each orifice having an edge, the edge defining a transition boundary between the orifice and the outer surface;

the wettability of the outer surface being poor near the edge of the at least one orifice, wherein the wettability increases gradually with increasing distance from the edge of the at least one orifice, wherein the wettability is determined by an anti-wetting agent provided on the outer surface thereof, wherein the wetting agent is provided such that a gradient in the anti-wetting agent is present in surface coverage of the outer surface thereof, the surface coverage being high near the edge of the at least one orifice and decreasing with increasing distance from the edge of the at least one orifice, and wherein the anti-wetting agent is provided in a pattern.

19. The orifice plate according to claim 18, wherein the pattern comprises a gradually decreasing surface coverage with the anti-wetting agent with increasing distance from the edge of the at least one orifice.

20. An ink jet print-head comprising the orifice plate of claim 18.

21. A printer comprising the ink jet print-head according to claim 20.

22. An orifice plate for an ink jet print-head for ejecting drops of an ink, the orifice plate comprising:

an outer surface, which has a wettability with the ink; and at least one orifice arranged in the outer surface, the orifice being configured for ejecting ink drops, each orifice having an edge, the edge defining a transition boundary between the orifice and the outer surface;

the wettability of the outer surface being poor near the edge of the at least one orifice, wherein the wettability increases gradually with increasing distance from the edge of the at least one orifice, and wherein the orifice plate comprises an area between two adjacent nozzles containing a wettability gradient such that the wettability with ink in the area between the two adjacent nozzles decreases with increasing distance from a diametric line between the two adjacent nozzles.

23. An ink jet print-head comprising the orifice plate of claim 22.

24. A printer comprising the ink jet print-head according to claim 23.

25. An orifice plate for an ink jet print-head for ejecting drops of an ink, the orifice plate comprising:

an outer surface, which has a wettability with the ink; and at least one orifice arranged in the outer surface, the orifice being configured for ejecting ink drops, each orifice having an edge, the edge defining a transition boundary between the orifice and the outer surface;

the wettability of the outer surface being poor near the edge of the at least one orifice, wherein the wettability increases gradually with increasing distance from the edge of the at least one orifice, wherein the wettability is determined by an anti-wetting agent provided on the outer surface thereof and wherein the outer surface of the orifice plate is provided with a transition layer, the transition layer being configured to accommodate the anti-wetting agent.

* * * * *